US012465078B2

(12) United States Patent
Liu et al.

(10) Patent No.: US 12,465,078 B2
(45) Date of Patent: Nov. 11, 2025

(54) ELECTRONIC CIGARETTE ATOMIZING CORE AND ATOMIZER

(71) Applicant: CHINA TOBACCO HUNAN INDUSTRIAL CO., LTD., Hunan (CN)

(72) Inventors: Jianfu Liu, Hunan (CN); Kejun Zhong, Hunan (CN); Xiaoyi Guo, Hunan (CN); Wei Huang, Hunan (CN); Xinqiang Yin, Hunan (CN); Jianhua Yi, Hunan (CN); Yongquan Zhou, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 854 days.

(21) Appl. No.: 17/438,404

(22) PCT Filed: Mar. 13, 2020

(86) PCT No.: PCT/CN2020/079123

§ 371 (c)(1),
(2) Date: Sep. 10, 2021

(87) PCT Pub. No.: WO2020/187138

PCT Pub. Date: Sep. 24, 2020

(65) Prior Publication Data

US 2022/0142246 A1 May 12, 2022

(30) Foreign Application Priority Data

Mar. 15, 2019 (CN) ..... 201910196623.3

(51) Int. Cl.
*A24F 40/10* (2020.01)
*A24F 40/05* (2020.01)
(Continued)

(52) U.S. Cl.
CPC ..... *A24F 40/10* (2020.01); *A24F 40/05* (2020.01); *A24F 40/42* (2020.01); *A24F 40/44* (2020.01); *A24F 40/485* (2020.01)

(58) Field of Classification Search
None
See application file for complete search history.

(56) References Cited

U.S. PATENT DOCUMENTS

2019/0320715 A1* 10/2019 Xiao ..... H05B 3/04
2020/0170305 A1* 6/2020 Tan ..... B65B 7/285

FOREIGN PATENT DOCUMENTS

CN 205695702 U * 11/2016 ..... A24F 40/05
CN 205757214 U 12/2016
(Continued)

OTHER PUBLICATIONS

CN-205695702-U English Translation obtained from Espacenet, pp. 1-14 (Year: 2016).*
(Continued)

*Primary Examiner* — Philip Y Louie
*Assistant Examiner* — Madeleine P Delacruz
(74) *Attorney, Agent, or Firm* — MASCHOFF BRENNAN; Ran Pang; Michael Mauriel

(57) ABSTRACT

An electronic cigarette atomizing core and an atomizer are provided. The atomizing core comprises an outer sleeve and an inner sleeve which are sleeved on each other. The side wall of the outer sleeve is provided with a first e-liquid passing port communicated with an e-liquid tank. Two ends of e-liquid guide cotton are sandwiched between the outer sleeve and the inner sleeve. The two ends of the e-liquid guide cotton cover the first e-liquid passing port. The bottom of the inner sleeve is provided with an atomization cavity. The side wall of the inner sleeve is provided with a plurality of air inlet grooves penetrating axially and communicated with the atomization cavity.

10 Claims, 5 Drawing Sheets

(51) Int. Cl.

| | |
|---|---|
| ***A24F 40/40*** | (2020.01) |
| ***A24F 40/42*** | (2020.01) |
| ***A24F 40/44*** | (2020.01) |
| ***A24F 40/485*** | (2020.01) |

(56) References Cited

FOREIGN PATENT DOCUMENTS

| | | | | | |
|---|---|---|---|---|---|
| CN | 206025225 | U | | 3/2017 | |
| CN | 206043451 | U | | 3/2017 | |
| CN | 206687174 | U | | 12/2017 | |
| CN | 207613203 | U | | 7/2018 | |
| CN | 209732615 | U | | 12/2019 | |
| WO | WO-2017161715 | A1 | * | 9/2017 | ..... A24F 40/05 |

OTHER PUBLICATIONS

CN205757214_U English Translation obtained from Espacenet, pp. 1-12 (Year: 2016).*

CN-206025225-U English Translation obtained from Espacenet, pp. 1-11 (Year: 2017).*

International Search Report issued in International Application No. PCT/CN2020/079123 dated Jun. 3, 2020, 3 pages.

* cited by examiner

ELECTRONIC CIGARETTE ATOMIZING CORE AND ATOMIZER

CROSS REFERENCE TO RELATED APPLICATIONS

This application is a U.S. National Phase application under 35 U.S.C. § 371 of International Application No. PCT/CN2020/079123 filed on Mar. 13, 2020, which claims priority to Chinese Application No. 201910196623.3 filed on Mar. 15, 2019. The entire content of these applications is hereby incorporated herein by reference.

FIELD OF THE INVENTION

The present invention relates to an electronic cigarette device, and in particular, to an electronic cigarette atomizing core and an atomizer.

BACKGROUND OF THE INVENTION

During ultrasonic atomization of the existing ultrasonic electronic cigarette atomizer, because the supply speed of e-liquid is slow, the ultrasonic atomizing sheet is easily dry-burnt. In addition, because the air pipe is directly communicated with the atomization cavity, the e-liquid splashed on the ultrasonic atomizing sheet enters the breather pipe connected with the suction nozzle during the atomization. Hence, the e-liquid is easily inhaled.

SUMMARY OF THE INVENTION

The technical problem to be solved by the present invention is to overcome the shortcomings of the prior art, and provide an electronic cigarette atomizing core that supplies e-liquid quickly to prevent dry burning of an ultrasonic atomizing sheet, and an atomizer.

In order to solve the above technical problems, the present invention provides an electronic cigarette atomizing core, including an outer sleeve and an inner sleeve which are sleeved on each other, wherein the side wall of the outer sleeve is provided with a first e-liquid passing port communicated with an e-liquid tank, two ends of e-liquid guide cotton are sandwiched between the outer sleeve and the inner sleeve, the bottom of the inner sleeve is provided with an atomization cavity, the side wall of the inner sleeve is provided with a plurality of air inlet grooves communicating with the atomization cavity along the axial direction as that of e-liquid flowing into the atomization cavity, and at least one air inlet groove is communicated with the first e-liquid passing port by means of the e-liquid guide cotton.

In the present invention, at least one air inlet groove is communicated with the surface of the e-liquid guide cotton, and the airflow direction in the air inlet groove is consistent with the flow direction of the e-liquid entering the atomization cavity. As such, during smoking, due to the air flow in the air inlet groove, the power of the air flow enables the e-liquid to overcome the adhesion of the e-liquid guide cotton, so that the flow speed of the e-liquid in the e-liquid guide cotton is increased. Meanwhile, the air pressure in the air inlet groove changes with the air flow, so that air pressure in the e-liquid tank is not balanced with air pressure in the air inlet groove. While the e-liquid passes through the first e-liquid passing port and is absorbed by the e-liquid guide cotton, a part of the intake air flow directly passes through the e-liquid guide cotton and then passes through the first e-liquid passing port into the sealed e-liquid tank to realize the replacement of e-liquid (just as bubbles appear in the e-liquid tank when smoking), which increases the air pressure in the e-liquid tank, and then increases the speed of the e-liquid from the e-liquid tank to the e-liquid guide cotton, so that sufficient e-liquid is supplied for the ultrasonic atomization of the ultrasonic atomizing sheet to ensure smoke, the time for replacing the e-liquid in the e-liquid tank is shortened, the e-liquid in the e-liquid tank is absorbed by the e-liquid guide cotton more quickly, the continuity of delivery of the e-liquid by the e-liquid guide cotton is better, and dry burning of the ultrasonic atomizing sheet is prevented.

Preferably, e-liquid guide cotton mounting grooves for mounting the e-liquid guide cotton are symmetrically formed on the outer wall of the inner sleeve, the e-liquid guide cotton mounting groove is provided with a clamping segment at the upper part for clamping the e-liquid guide cotton and a loosening segment at the lower part, the depth of the e-liquid guide cotton mounting groove at the clamping segment is less than that of the e-liquid guide cotton mounting groove at the loosening segment, and at least one air inlet groove penetrates the loosening segment, so that the e-liquid guide cotton and the inner sleeve form a whole.

Preferably, four air inlet grooves penetrating axially are evenly distributed on the side wall of the inner sleeve, and at least two symmetrical air inlet grooves penetrate the loosening segments of the e-liquid guide cotton mounting grooves. Since at least two air inlet grooves are arranged symmetrically and penetrate the loosening segments, and the shunt intake air flow in the two air inlet grooves are the same, the intake air flows have the same influence on the speed of delivery of e-liquid by the e-liquid guide cotton, which prevents the atomization effect of the ultrasonic atomizing sheet from being affected by different quantities of e-liquid delivered on the left and right sides of the e-liquid guide cotton, and also enables the smoke in the atomization cavity at the bottom of the air inlet grooves from being taken away more thoroughly.

Preferably, a first upward rib is disposed on the clamping segment, for against a part of the e-liquid guide cotton in the outer sleeve, to reduce large friction produced by large-area extrusion contact between the e-liquid guide cotton and the outer sleeve, and to prevent the e-liquid guide cotton from staying in the outer sleeve when the inner sleeve is pulled out in order to replace the e-liquid guide cotton; a second upward rib is disposed on the loosening segment, for setting the e-liquid guide cotton such that the loosened e-liquid guide cotton is wave-shaped, which enhances the adhesion of e-liquid in this shape, thereby reducing the flow rate of the e-liquid there when the user is not smoking, and preventing the ultrasonic atomizing sheet from being soaked by the e-liquid. In addition, because the air inlet grooves are communicated with the loosening segments, the air flow force overcomes the adhesion of the e-liquid to the wave-shaped e-liquid guide cotton when smoking, the e-liquid flows faster, and the reduction of smoke due to insufficient e-liquid supply and the dry burning and cracking of the ultrasonic atomizing sheet are prevented.

Preferably, the middle part of the inner cavity of the inner sleeve is provided with a boss for sealing and clamping a breather pipe, and an air outlet cavity is formed at the lower part of the inner cavity of the inner sleeve under the boss, so that the e-liquid splashed during ultrasonic atomization is condensed in the air outlet cavity, and the user hardly inhales the e-liquid.

Preferably, the upper part of the inner cavity of the outer sleeve is sleeved with the inner sleeve, and a spring is disposed between the bottom of the inner sleeve and the e-liquid guide cotton; an ultrasonic atomizing sheet, an elastic insulating seat and an electrode assembly are sequentially disposed at the lower part of the inner cavity of the outer sleeve from top down, and the atomization cavity is formed between the bottom of the inner sleeve and the ultrasonic atomizing sheet; a first electrode is disposed on the upper surface of the ultrasonic atomizing sheet, and a second electrode is disposed on the lower surface of the ultrasonic atomizing sheet; the electrode assembly includes a first electrical connection terminal and a second electrical connection terminal separated by an insulating ring, the inner wall of the outer sleeve is directly electrically connected to the first electrode of the ultrasonic atomizing sheet and the second electrical connection terminal of the electrode assembly, and the second electrode of the ultrasonic atomizing sheet is electrically connected to the first electrical connection terminal of the electrode assembly.

Preferably, the upper part of the inner wall of the outer sleeve is provided with a support portion, the top of the outer wall of the inner sleeve is provided with a step, and the step is clamped and fixed on the support portion to fixedly connect the inner sleeve with the outer sleeve.

Preferably, the lower part of the inner wall of the outer sleeve is provided with a resisting portion for resisting the first electrode of the ultrasonic atomizing sheet to form an electrical connection, and a yielding portion for preventing the side wall of the ultrasonic atomizing sheet from being broken due to extrusion surrounds the periphery of the resisting portion, so that the assembled ultrasonic atomizing sheet is only subject to the resisting force of the resisting portion.

In order to solve the above technical problems, the present invention further provides an electronic cigarette atomizer, including an e-liquid tank device and a suction nozzle device which are connected to each other and are rotatable relatively, wherein an e-liquid tank is disposed inside the e-liquid tank device, the suction nozzle device is provided with a second air inlet channel and a suction nozzle, the above-mentioned electronic cigarette atomizing core is disposed in the e-liquid tank device, a breather pipe is disposed between the suction nozzle and the boss of the inner sleeve, a third air inlet channel is formed between the outer wall of the breather pipe and the suction nozzle device and between the outer wall of the breather pipe and the e-liquid tank device, and the second air inlet channel is communicated with the air inlet grooves through the third air inlet channel.

Compared with the prior art, the beneficial effects of the present invention are:

1. With the help of the airflow power during smoking, the flow rate of e-liquid on the e-liquid guide cotton is increased, and the replacement of the air and the e-liquid in the sealed e-liquid tank is accelerated, thereby preventing insufficient e-liquid supply when smoking;
2. An e-liquid obstruction structure (lower e-liquid rib) is disposed at a position corresponding to an e-liquid guide segment that effectively guides e-liquid together with the e-liquid guide cotton, which prevents the ultrasonic atomizing sheet from being soaked by excessive e-liquid guided thereto when the user is not smoking to affect the first puff of smoke during smoking.

DETAILED DESCRIPTION OF EMBODIMENTS

Figure 1:
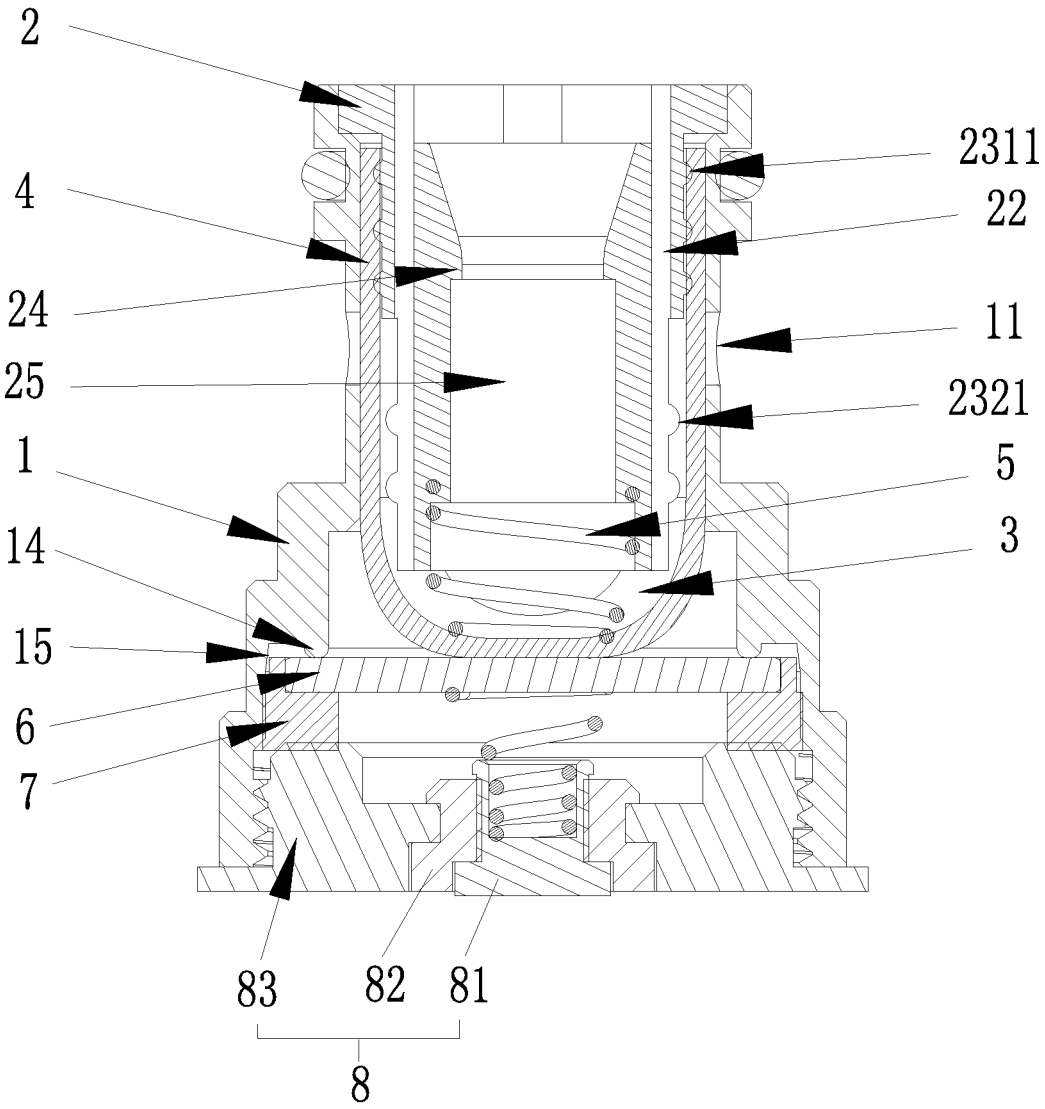
FIG. 1 is a cross-sectional structure diagram of an embodiment of an electronic cigarette atomizing core according to the present invention.
Figure 2:
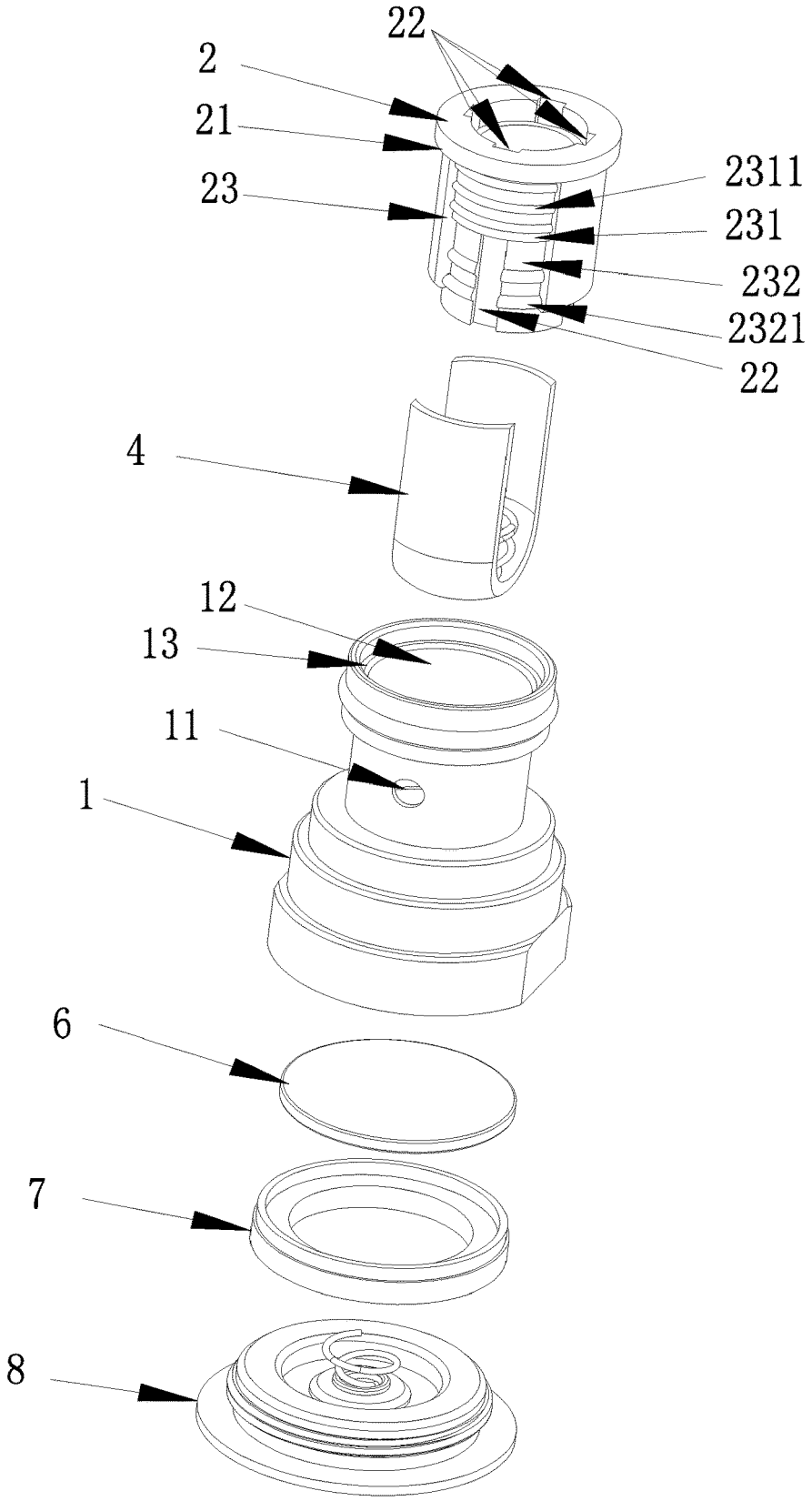
FIG. 2 is an exploded structure diagram of components of an embodiment of the electronic cigarette atomizing core according to the present invention.
Figure 3:
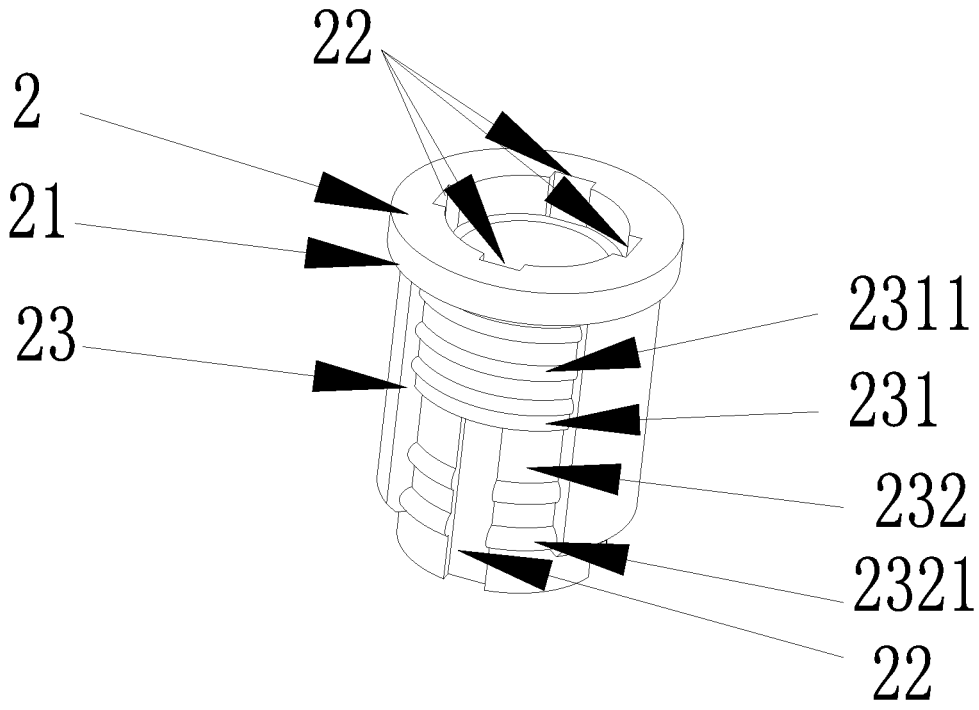
FIG. 3 is a schematic structure diagram of an inner sleeve according to the present invention.
Figure 4:
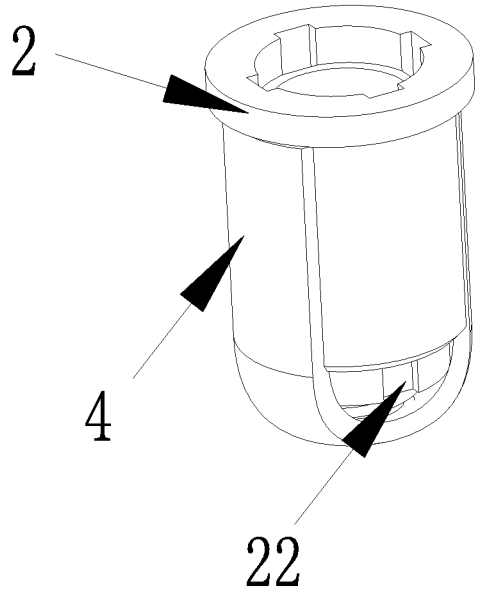
FIG. 4 is an assembly structure diagram of the inner sleeve and e-liquid guide cotton according to the present invention.

The present invention will be further described below with reference to specific preferred embodiments, but the scope of protection of the present invention is not limited thereby.

For ease of description, the relative positional relationships (e.g., upper, lower, left, right, etc.) of components are described according to the layout direction of the accompanying drawings in the specification, and do not limit the structure of this patent.

Embodiment 1:

As shown in FIGS. 1 to 4, an embodiment of an electronic cigarette atomizing core C according to the present invention includes an outer sleeve 1 made of a conductive material, an inner sleeve 2 is sleeved at the upper part of an inner cavity of the outer sleeve 1, and an ultrasonic atomizing sheet 6, an elastic insulating seat 7 and an electrode assembly 8 are sequentially disposed at the lower part of the inner cavity of the outer sleeve 1 from top down. Two ends of e-liquid guide cotton 4 are sandwiched between the outer sleeve 1 and the inner sleeve 2, a spring 5 is mounted at the bottom of the inner sleeve 2, and the spring 5 holds the middle part of the e-liquid guide cotton 4 on an atomization zone of the ultrasonic atomizing sheet 6. An atomization cavity is formed between the ultrasonic atomizing sheet 6 and the bottom of the inner sleeve 2. The ultrasonic atomizing sheet 6 is made of piezoelectric ceramics, its upper surface is covered with a first electrode, its lower surface is covered with a second electrode, and the middle part of the upper surface is the atomization zone. The electrode assembly 8 is used to provide electrical connection for the ultrasonic atomizing sheet 6, and the electrode assembly 8 includes a first electrical connection terminal 81, an insulating ring 82 and a second electrical connection terminal 83 which are sleeved with each other from inside to outside. The first electrode of the ultrasonic atomizing sheet 6 is electrically connected to the second electrical connection terminal 83 of the electrode assembly 8 through the outer sleeve 1, and the second electrode of the ultrasonic atomizing sheet 6 is electrically connected to the first electrical connection terminal 81 of the electrode assembly 8.

The side wall of the outer sleeve 1 is provided with a first e-liquid passing port 11 communicated with an e-liquid outlet of an e-liquid tank, the top of the outer sleeve 1 is provided with an insertion port 12 for placing in the inner sleeve 2, the upper part of the inner wall of the outer sleeve 1 is provided with a support portion 13 for supporting the inner sleeve 2, the lower part of the inner wall of the outer sleeve 1 is provided with a resisting portion 14 for resisting the first electrode of the ultrasonic atomizing sheet 6, and a yielding portion 15 for preventing the side wall of the ultrasonic atomizing sheet 6 from being broken due to extrusion surrounds the periphery of the resisting portion 14. After the atomizing core is assembled, the ultrasonic atomizing sheet 6 is only subject to the axial resisting force of the resisting portion 14, which prevents the ultrasonic atomizing sheet 6 from being damaged by a radial force.

The top of the outer wall of the inner sleeve 2 is provided with a step 21. Four air inlet grooves 22 penetrating axially and communicated with the atomization cavity 3 are evenly distributed on the side wall of the inner sleeve 2, and the air inlet grooves 22 are located inside the first e-liquid passing port 11. E-liquid guide cotton mounting grooves 23 are symmetrically formed on the outer wall of the inner sleeve 2, the e-liquid guide cotton mounting groove 23 is provided with a clamping segment 231 at the upper part for clamping the e-liquid guide cotton and a loosening segment 232 at the lower part that has a depth greater than that of the clamping segment 231, and two air inlet grooves 22 are arranged opposite to the e-liquid guide cotton mounting grooves 23 and penetrate the loosening segments 232. A first upward rib 2311 is disposed on the clamping segment 231, for holding a part of the e-liquid guide cotton 4 in the outer sleeve 1, to reduce large friction produced by large-area extrusion contact between the e-liquid guide cotton 4 and the outer sleeve 1, and to prevent the e-liquid guide cotton 4 from staying in the outer sleeve 1 when the inner sleeve 2 is pulled out to replace the e-liquid guide cotton 4; a second upward rib 2321 is disposed on the loosening segment 232, for setting the e-liquid guide cotton 4 such that the loosened e-liquid guide cotton 4 is wave-shaped, which enhances the adhesion of e-liquid in the wave-shaped e-liquid guide cotton 4, thereby reducing the flow rate of the e-liquid there when the user is not smoking, and preventing the ultrasonic atomizing sheet 6 from being soaked by the e-liquid. In addition, because a part of the air inlet groove 22 is located in the loosening segment 232 and communicated with the loosening segment 232, the flow rate of the e-liquid on the e-liquid guide cotton 4 can be increased by means of intake air flow when smoking; and a part of the air flow can enter the e-liquid tank through the first e-liquid passing port 11 to replace the e-liquid in the sealed oil tank, so that the e-liquid outlet speed of the e-liquid tank is faster, which prevents the reduction of smoke due to insufficient e-liquid when smoking and the dry burning and cracking of the ultrasonic atomizing sheet. The middle part of the inner cavity of the inner sleeve 2 is provided with a boss 24 for sealing and clamping a breather pipe 9, and the inner cavity of the inner sleeve 2 under the boss 24 is configured as an air outlet cavity 25, so that the e-liquid splashed during the ultrasonic atomization of the ultrasonic atomizing sheet 6 is condensed in the air outlet cavity 25, and the user hardly inhales the e-liquid.

Since the atomization cavity 3 is formed between the ultrasonic atomizing sheet 6 and the bottom of the inner sleeve 2, when the breather pipe 9 is inserted into the boss 24 of the inner sleeve 2 and the outer wall of the breather pipe 9 is clamped and sealed by the boss 24, the intake air flow can only enter the atomization cavity 3 from the four air inlet grooves 22, then passes through the atomization surface of the ultrasonic atomizing sheet 6 to take away smoke, and exits through the air outlet cavity 25 and the breather pipe 9. Since the four air inlet grooves 22 are evenly distributed, and the intake air flow in the four air inlet grooves is the same, equal air flow enters from four directions of the atomization cavity to take away the smoke, so that the smoke in the atomization cavity 3 is taken away more thoroughly.

When the atomizing core is assembled, the e-liquid guide cotton 4 placed with the spring 5 at the middle part is inserted from the bottom of the inner sleeve 2 upwards into the e-liquid guide cotton mounting grooves 23, the two ends of the e-liquid guide cotton 4 are respectively sleeved in the e-liquid guide cotton mounting grooves 23 on two sides of the inner sleeve 2, and the e-liquid guide cotton 4 and the inner sleeve 2 form a whole; then the inner sleeve 2 mounted with the e-liquid guide cotton 4 is inserted into the outer sleeve 1 through the insertion port 12 and clamped with the inner wall of the outer sleeve 1 tightly, the e-liquid guide cotton 4 is fixed more stably, the step 21 is caught and fixed on the support portion 13 to fixedly connect the inner sleeve 2 with the outer sleeve 1, and the loosening segment 232 is aligned with the e-liquid passing port 11 so that the e-liquid guide cotton 4 can fully store and guide e-liquid; finally, the ultrasonic atomizing sheet 6, the elastic insulating seat 7 and the electrode assembly 8 are sequentially placed on the bottom of the e-liquid guide cotton 4, the resisting portion 14 on the inner wall of the outer sleeve 1 presses against the first electrode of the ultrasonic atomizing sheet 6, the bottom of the inner wall of the outer sleeve 1 is connected to the second electrical connection terminal 83 of the electrode assembly 8 through threads, and the second electrode of the ultrasonic atomizing sheet 6 is electrically connected to the first electrical connection terminal 81 of the electrode assembly 8.

The above assembly method is only an option. Obviously, the ultrasonic atomizing sheet 6, the elastic insulating seat 7 and the electrode assembly 8 may also be first mounted at the lower part of the inner cavity of the outer sleeve 1, and then the inner sleeve 2 mounted with the e-liquid guide cotton 4 is inserted into the outer sleeve 1 and clamped with the inner wall of the outer sleeve 1 tightly.

Figure 5:
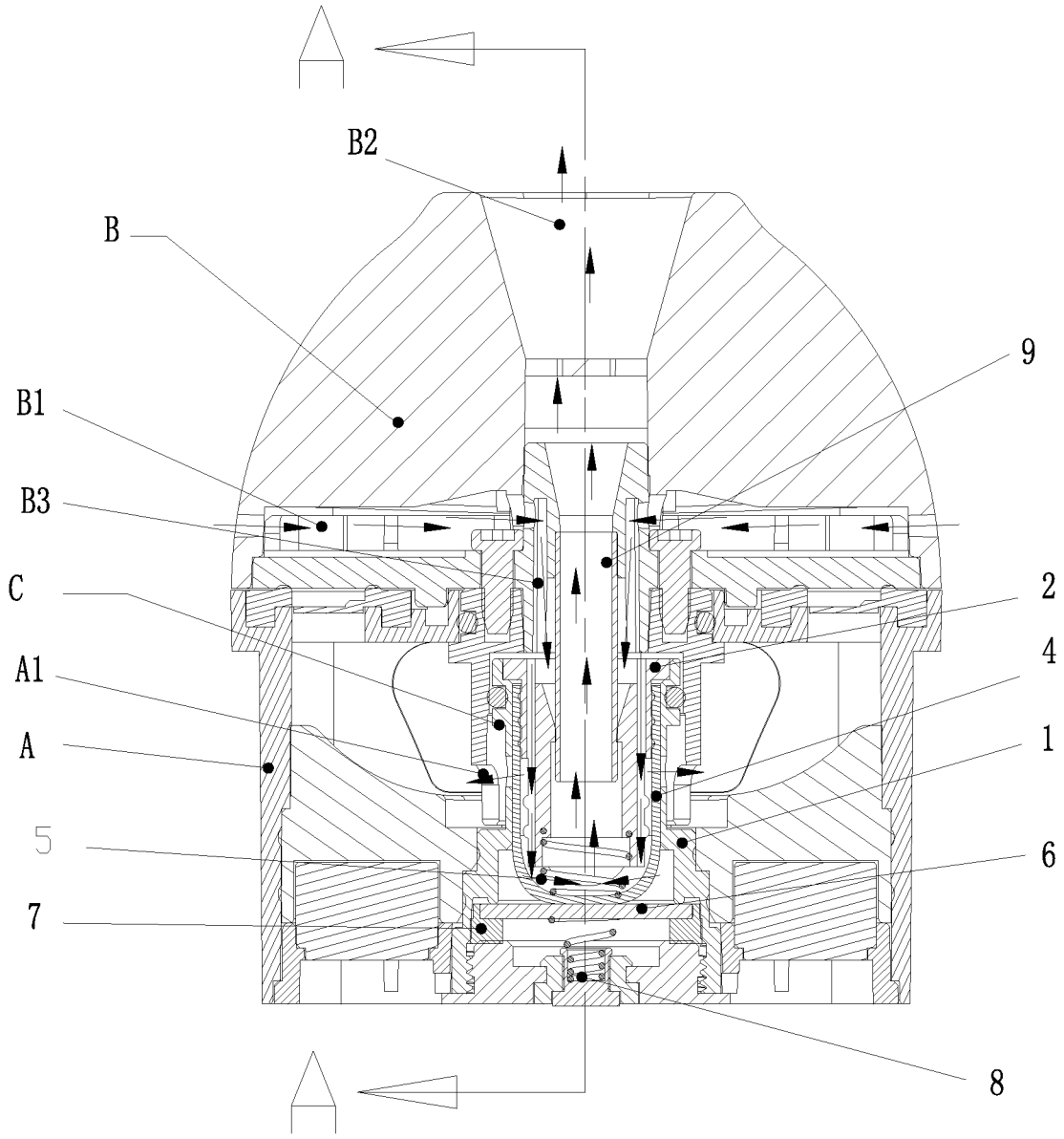
FIG. 5 is a cross-sectional structure diagram of an embodiment of an electronic cigarette atomizer according to the present invention.
Figure 6:
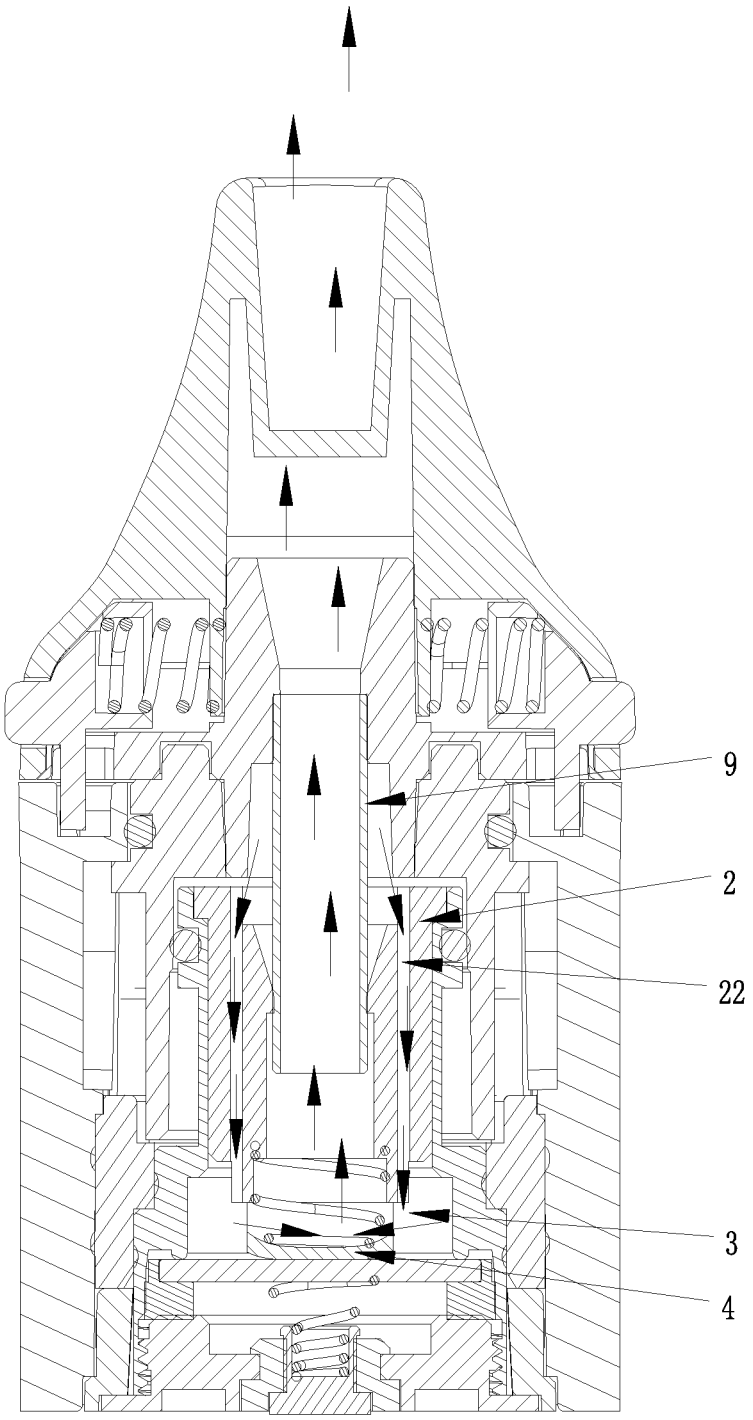
FIG. 6 is a cross-sectional view taken along line A-A in FIG. 5.

As shown in FIGS. 5 and 6, an embodiment of an electronic cigarette atomizer according to the present invention includes an e-liquid tank device A accommodating the above-mentioned atomizing core C. An e-liquid outlet A1 of the e-liquid tank device A is communicated with the first e-liquid passing port on the atomizing sleeve 1, such that e-liquid flows onto the e-liquid guide cotton 4 through a second e-liquid passing port 31 and the first e-liquid passing port 11, and then arrives at the atomization surface of the ultrasonic atomizing sheet 6 through the e-liquid guide cotton 4 to form smoke. The top of the e-liquid tank device A is provided with a suction nozzle device B, the suction nozzle device B is provided with a second air inlet channel B1 and a suction nozzle B2, the breather pipe 9 is disposed between the suction nozzle B2 and the air outlet cavity 25 of the atomizing core C, a third air inlet channel B3 is formed between the outer wall of the breather pipe 9 and the suction nozzle device B and between the outer wall of the breather pipe 9 and the e-liquid tank device A, and the second air inlet channel B1 is communicated with the air inlet grooves 22 through the third air inlet channel B3.

The forgoing descriptions are only preferred embodiments of the present application, and do not limit the present application in any form. Although the present application is disclosed above with the preferred embodiments, the present application is not limited thereto. Some variations or modifications made by any skilled person familiar with the art using the disclosed technical contents without departing from the scope of the technical solution of the present application are equivalent to the embodiments, and all fall within the scope of the technical solution.

The invention claimed is:

1. An electronic cigarette atomizing core comprising:

an outer sleeve and an inner sleeve which are sleeved on each other, wherein:

a side wall of the outer sleeve is provided with a first e-liquid passing port communicated with an e-liquid tank, two ends of e-liquid guide cotton are sandwiched between the outer sleeve and the inner sleeve, an atomization cavity is provided below a bottom of the inner sleeve, characterized in that a side wall of the inner sleeve is provided with a plurality of air inlet grooves penetrating the atomization cavity axially and in a same direction as e-liquid flowing into the atomization cavity, at least one air inlet groove is communicated with the first e-liquid passing port by means of the e-liquid guide cotton such that a part of air flowing through the at least one air inlet groove directly passes through the e-liquid guide cotton and then passes through the first e-liquid passing port into the e-liquid tank to realize replacement of e-liquid, e-liquid guide cotton mounting grooves for mounting the e-liquid guide cotton are symmetrically formed on an outer wall of the inner sleeve, the e-liquid guide cotton mounting grooves are provided with a clamping segment at an upper part for clamping the e-liquid guide cotton and a loosening segment at the lower part, a depth of the e-liquid guide cotton mounting grooves at the clamping segment is less than that of the e-liquid guide cotton mounting grooves at the loosening segment, and at least one air inlet groove penetrates the loosening segment.

2. The electronic cigarette atomizing core according to claim 1, wherein:

four air inlet grooves penetrating axially are evenly distributed on the side wall of the inner sleeve, and at least two symmetrical air inlet grooves penetrate the loosening segments of the e-liquid guide cotton mounting grooves.

3. The electronic cigarette atomizing core according to claim 1, wherein:

a first upward rib is disposed on the clamping segment, and a second upward rib is disposed on the loosening segment.

4. An electronic cigarette atomizer, comprising:

an e-liquid tank device and a suction nozzle device which are connected and rotatable relatively to each other, wherein:

an e-liquid tank is disposed inside the e-liquid tank device, the suction nozzle device is provided with a second air inlet channel and a suction nozzle, the electronic cigarette atomizing core according to claim 1 is disposed in the e-liquid tank device, a breather pipe is disposed between the suction nozzle and the boss of the inner sleeve, a third air inlet channel is formed between the outer wall of the breather pipe and the suction nozzle device and between the outer wall of the breather pipe and the e-liquid tank device, and the second air inlet channel is communicated with the air inlet grooves through the third air inlet channel.

5. An electronic cigarette atomizing core comprising:

an outer sleeve and an inner sleeve which are sleeved on each other, wherein:

a side wall of the outer sleeve is provided with a first e-liquid passing port communicated with an e-liquid tank, two ends of e-liquid guide cotton are sandwiched between the outer sleeve and the inner sleeve, an atomization cavity is provided below a bottom of the inner sleeve, characterized in that a side wall of the inner sleeve is provided with a plurality of air inlet grooves penetrating the atomization cavity axially and in a same direction as e-liquid flowing into the atomization cavity, at least one air inlet groove is communicated with the first e-liquid passing port by means of the e-liquid guide cotton such that a part of air flowing through the at least one air inlet groove directly passes through the e-liquid guide cotton and then passes through the first e-liquid passing port into the e-liquid tank to realize replacement of e-liquid, a middle part of an inner cavity of the inner sleeve is provided with a boss for sealing and clamping a breather pipe, an air outlet cavity is formed at a lower part of the inner cavity of the inner sleeve under the boss, an upper part of the inner cavity of the outer sleeve is sleeved with the inner sleeve, and a spring is disposed between the bottom of the inner sleeve and the e-liquid guide cotton;

an ultrasonic atomizing sheet, an elastic insulating seat and an electrode assembly are sequentially disposed at the lower part of the inner cavity of the outer sleeve from top down, and the atomization cavity is formed between the bottom of the inner sleeve and the ultrasonic atomizing sheet;

a first electrode is disposed on an upper surface of the ultrasonic atomizing sheet, and a second electrode is disposed on the lower surface of the ultrasonic atomizing sheet; and the electrode assembly comprises a first electrical connection terminal and a second electrical connection terminal separated by an insulating ring, an inner wall of the outer sleeve is directly electrically connected to the first electrode of the ultrasonic atomizing sheet and the second electrical connection terminal of the electrode assembly, and the second electrode of the ultrasonic atomizing sheet is electrically connected to the first electrical connection terminal of the electrode assembly.

6. The electronic cigarette atomizing core according to claim 5, wherein a lower part of the inner wall of the outer sleeve is provided with a resisting portion for resisting the first electrode of the ultrasonic atomizing sheet.

7. The electronic cigarette atomizing core according to claim 6, wherein a yielding portion, for preventing the side wall of the ultrasonic atomizing sheet from being broken due to extrusion, surrounds a periphery of the resisting portion.

8. An electronic cigarette atomizer, comprising:

an e-liquid tank device and a suction nozzle device which are connected and rotatable relatively to each other, wherein:

an e-liquid tank is disposed inside the e-liquid tank device, the suction nozzle device is provided with a second air inlet channel and a suction nozzle, the electronic cigarette atomizing core according to claim 5 is disposed in the e-liquid tank device, a breather pipe is disposed between the suction nozzle and the boss of the inner sleeve, a third air inlet channel is formed between the outer wall of the breather pipe and the suction nozzle device and between the outer wall of the breather pipe and the e-liquid tank device, and the second air inlet channel is communicated with the air inlet grooves through the third air inlet channel.

9. An electronic cigarette atomizing core comprising:

an outer sleeve and an inner sleeve which are sleeved on each other, wherein:

a side wall of the outer sleeve is provided with a first e-liquid passing port communicated with an e-liquid tank, two ends of e-liquid guide cotton are sandwiched between the outer sleeve and the inner sleeve, an atomization cavity is provided below the bottom of the inner sleeve, characterized in that the side wall of the inner sleeve is provided with a plurality of air inlet grooves penetrating the atomization cavity axially and in the same direction as e-liquid flowing into the atomization cavity, at least one air inlet groove is communicated with the first e-liquid passing port by means of the e-liquid guide cotton such that a part of air flowing through the at least one air inlet groove directly passes through the e-liquid guide cotton and then passes through the first e-liquid passing port into the e-liquid tank to realize replacement of e-liquid, an upper part of an inner wall of the outer sleeve is provided with a support portion, a top of an outer wall of the inner sleeve is provided with a step, and the step is supported by the support portion.

10. An electronic cigarette atomizer, comprising:

an e-liquid tank device and a suction nozzle device which are connected and rotatable relatively to each other, wherein:

an e-liquid tank is disposed inside the e-liquid tank device, the suction nozzle device is provided with a second air inlet channel and a suction nozzle, the electronic cigarette atomizing core according to claim 9 is disposed in the e-liquid tank device, a breather pipe is disposed between the suction nozzle and the boss of the inner sleeve, a third air inlet channel is formed between the outer wall of the breather pipe and the suction nozzle device and between the outer wall of the breather pipe and the e-liquid tank device, and the second air inlet channel is communicated with the air inlet grooves through the third air inlet channel.

* * * * *